US010502100B2

(12) United States Patent
Snyder et al.

(10) Patent No.: US 10,502,100 B2
(45) Date of Patent: Dec. 10, 2019

(54) CAM PHASER

(71) Applicant: ECO Holding 1 GmbH, Marktheidenfeld (DE)

(72) Inventors: John Snyder, Irving, TX (US); Wes Gerszewski, Copell, TX (US); Steven Nance, Highland Village, TX (US); Daniel Sing, Murphy, TX (US)

(73) Assignee: ECO Holding 1 GmbH, Marktheidenfeld (DE)

( * ) Notice: Subject to any disclaimer, the term of this patent is extended or adjusted under 35 U.S.C. 154(b) by 40 days.

(21) Appl. No.: 15/705,612

(22) Filed: Sep. 15, 2017

(65) Prior Publication Data

US 2019/0085733 A1 Mar. 21, 2019

(51) Int. Cl.

| | |
|---|---|
| ***F01L 1/34*** | (2006.01) |
| ***F01L 1/344*** | (2006.01) |
| *F01L 1/047* | (2006.01) |

(52) U.S. Cl.

CPC ..... *F01L 1/3442* (2013.01); *F01L 1/047* (2013.01); *F01L 2001/34426* (2013.01); *F01L 2001/34453* (2013.01); *F01L 2001/34469* (2013.01); *F01L 2250/02* (2013.01); *F01L 2250/04* (2013.01)

(58) Field of Classification Search

CPC ..... F01L 1/3442; F01L 1/047; F01L 2001/34426; F01L 2001/34453

See application file for complete search history.

(56) References Cited

U.S. PATENT DOCUMENTS

2002/0078913 A1* 6/2002 Fukuhara ..... F01L 1/344 123/90.17

2016/0010515 A1* 1/2016 Snyder ..... F01L 1/3442 123/90.15

* cited by examiner

*Primary Examiner* — Zelalem Eshete

(74) *Attorney, Agent, or Firm* — Von Rohrscheidt Patents

(57) ABSTRACT

A cam phaser including a rotor; and a stator, wherein the rotor is rotatable relative to the stator about a rotation axis of the rotor, wherein a blade of the rotor is arrangeable at various positions between two bars of the stator, wherein an intermediary space formed between the two bars is divided by the blade of the rotor into a first pressure cavity and a second pressure cavity, wherein a locking device including a locking bolt that is spring loaded by a preload element and by a locking disc is configured to lock the stator with the rotor, wherein the preload element includes a spring force for locking, wherein the locking bolt is received axially movable in a receiving opening that is flowable by a hydraulic fluid and that is oriented in a direction of a longitudinal axis of the receiving opening that is formed in the rotor.

10 Claims, 4 Drawing Sheets

CAM PHASER

FIELD OF THE INVENTION

The invention relates to a cam phaser.

BACKGROUND OF THE INVENTION

Cam phasers for internal combustion engines are well known. In a typical cam phaser a locking bolt that is adjustable in a controlled manner is arranged with a sliding fit in a bore hole in a rotor blade of the cam phaser in order to block the rotor from rotating relative to the stator under particular operating conditions of the cam phaser and of the engine. A known locking device includes a locking bolt and a reset spring which loads the bolt in a hardened support, so that the rotor is locked relative to a stator that is fixed relative to the cog wheel or the sprocket.

Typically the locking device is unlocked by loading the locking bolt with a hydraulic pressure which corresponds to a pressure in a pressure cavity. The locking is performed by the reset spring, subsequently designated as preload element. This means that the hydraulic pressure of the pressure cavity has to cause a resulting force on the locking bolt, wherein the resulting force is greater than a spring force of the preload element which is typically provided as a coil spring. On the other hand side the spring force has to be greater than the resulting force of the hydraulic pressure in order to provide safe locking.

The resulting force of the hydraulic pressure is a function of a viscosity of the hydraulic fluid, of corresponding channels through which the hydraulic fluid runs for loading the locking bolt and of a configuration of the hydraulic valve of the cam phaser and a configuration of a hydraulic valve of the cam phaser through which the pressure chambers are hydraulically loaded. Thus, it can occur that a resulting torsion torque reaches spike values in applications with high cam shaft speeds which can lead to unlocking since the pressure from the pressure cavity which is provided for unlocking increases.

BRIEF SUMMARY OF THE INVENTION

Thus it is an object of the instant invention to provide a cam phaser which provides improved operational safety.

The object is achieved according to the invention by a cam phaser including a rotor; and a stator, wherein the rotor is rotatable relative to the stator about a rotation axis of the rotor, wherein a blade of the rotor is arrangeable at various positions between two bars of the stator, wherein an intermediary space formed between the two bars is divided by the blade of the rotor into a first pressure cavity and a second pressure cavity, wherein a locking device including a locking bolt that is spring loaded by a preload element and by a locking disc is configured to lock the stator with the rotor, wherein the preload element includes a spring force for locking, wherein the locking bolt is received axially movable in a receiving opening that is flowable by a hydraulic fluid and that is oriented in a direction of a longitudinal axis of the receiving opening that is formed in the rotor, wherein the rotor is movable by pressures provided in the first pressure cavity and in the second pressure cavity, wherein the rotor includes a locking position for locking, wherein a hydraulic valve is provided for pressure loading and pressure relief, wherein the locking device is configured to position the locking bolt by the spring force and by an additional force directly impacting the locking bolt.

Advantageous embodiments and useful and non-trivial improvements of the invention are provided in the respective dependent claims.

The cam phaser according to the invention includes a rotor and a stator wherein the rotor is rotatable relative to the stator about a rotation axis of the rotor. Between two bars of the stator a blade of the rotor is arrangeable in various positions, wherein the blade divides an intermediary space between the two bars into a first pressure cavity and a second pressure cavity. In order to interlock the stator with the rotor a locking device is provided which includes a locking bolt that is spring loaded by a preloading element and an interlocking disc. The preload element provides a spring force for locking. The locking bolt is received axially movable in a direction of a longitudinal axis of a receiving opening in the flowable receiving opening that is configured in the rotor. The rotor is movable by pressures provided in the pressure cavities and includes an interlocking position for interlocking.

Furthermore a hydraulic valve is provided for pressure loading and pressure relief. According to the invention the locking device is configured for positioning the locking bolt by the spring force and by an additional force directly impacting the locking bolt. Since an additional force impacts the locking bolt in addition to the spring force the locking bolt can be moved into its locking position more quickly. The preload element can also be advantageously configured smaller if the velocity of the locking bolt is sufficient.

The additional force can be generated in different ways. It has proven particularly cost effective to use the hydraulic fluid that is provided in a cam phaser. This means that the additional force advantageously is a hydraulic force of the hydraulic fluid flowing through the cam phaser. The advantage is that no additional auxiliary devices of an electrical or magnetic type are required.

In an advantageous embodiment the spring force and the hydraulic force are oriented in the same direction. This means put differently that they load the locking bolt from the same direction so that a resulting force that is a sum of both forces impacts the locking bolt.

In another embodiment the additional force provides the pressure that is required to move the rotor into the locking position. This means that the pressure which is provided for moving the rotor into the locking position acts simultaneously with the additional force that supports the spring force.

Advantageously the locking bolt is configured loadable at an end oriented towards the locking disc with a hydraulic pressure of a first operating connection of the hydraulic valve and configured loadable at its end that is oriented away from the locking disc with a hydraulic pressure of a second operating connection of the hydraulic valve. Thus, the pressure required for locking and the pressure required for unlocking and the forces resulting from these pressures can be implemented in a simple manner.

The receiving opening can be produced in a simple and cost effective manner by fabricating a bore hole. Closing the bore hole by a flowable support element which uses the locking device of the known cam phaser for ventilation is not necessary any more since an adjustment of the locking device is performed quasi self-regulating using the pressure provided in the pressure chambers. Thus, also the wear at the support element is eliminated which reduces production and maintenance cost.

Since a complex ventilation system is not required any more the cam phaser can be provided sealed in its entirety.

As a matter of principle the cam phaser according to the invention provides an improved, quicker and safer closing function.

In order to provide a particularly advantageous adjustment an opening of a second loading channel of the cam phaser which is used for feeding the hydraulic fluid into the receiving opening in order to generate the additional force is configured at an end portion of the receiving opening that is oriented away from the locking disc. When the inlet is configured at an end of the receiving opening that is oriented away from the locking disc and/or between a shoulder of the receiving opening that is provided for limiting a movement of the locking bolt and the end of the receiving opening a large additional force that is oriented in the same direction can be generated.

In another embodiment a first loading channel of the cam phaser is at least partially configured in the locking disc wherein the first loading channel is flow connected with the receiving opening in order to pressure load the locking bolt during unlocking which yields the advantage of a simple production of the loading channel since the locking disc can be handled in a more simple manner than the rotor.

In another embodiment the locking disc is configured as a drive gear that is connected torque proof with the cam shaft which provides a particularly economical cam phaser.

BRIEF DESCRIPTION OF THE DRAWINGS

Further advantages, features and details of the invention can be derived from the subsequent description of advantageous embodiments and the drawing figures. The features and feature combinations recited in the description and features and feature combinations recited individually in the subsequent figure description and/or in the figures are not only useable in the respectively recited combination but also in other combinations or individually without departing from the spirit and scope of the invention. Identical or equivalent elements are associated with identical reference numerals. For reasons of clarity the elements may not be provided with reference numerals is all figures without losing their association, wherein.

DETAILED DESCRIPTION OF THE INVENTION

Figure 1:
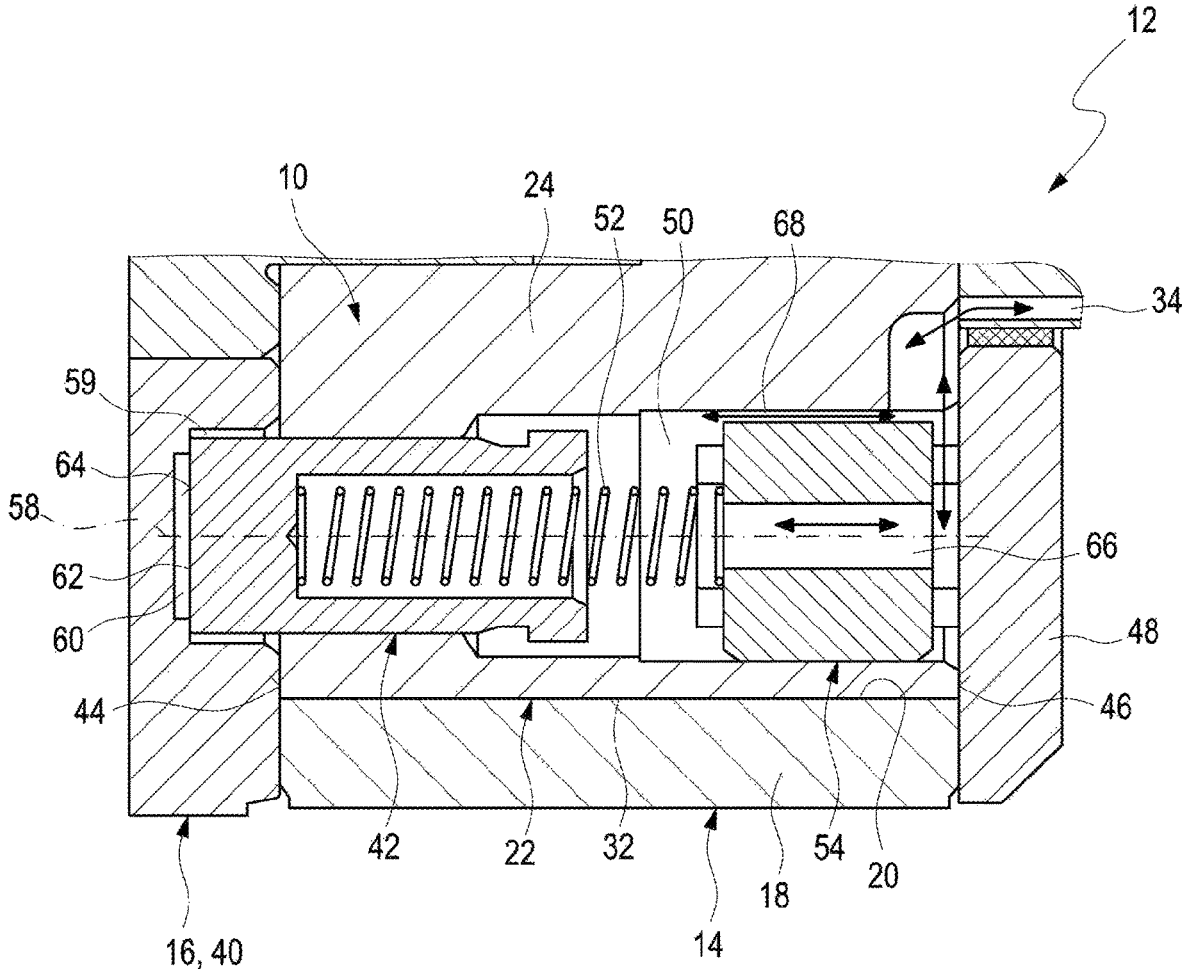
FIG. 1 (PRIOR ART)
FIG. 1 illustrates a longitudinal sectional view of a detail of a known cam phaser.

A locking device 10 of a known cam phaser 12 is configured as illustrated in FIG. 1. The cam phaser 12 facilitates changing opening and closing times of gas control valves of the internal combustion engine during operations of the internal combustion engine that is not illustrated in more detail.

Thus the cam phaser 12 continually adjusts a relative angular position of a cam shaft that is not illustrated in detail of an internal combustion engine relative to a crankshaft that is not illustrated in detail of the internal combustion engine, wherein the cam shaft is rotated relative to the crank shaft. Rotating the cam shaft moves opening and closing times of the gas control valves so that the internal combustion engine delivers optimum power at a respective speed.

The cam phaser 12 includes a cylindrical stator 14 which is connected torque proof with a drive gear 16 which is connected torque proof with the cam shaft. The drive gear 16 is a sprocket over which a chain that is not illustrated in more detail is run as a drive element. By the same token the drive gear 16 can also be a cog wheel over which a timing belt is run as a drive element. Through this drive element and the drive gear 16 the stator 14 is operatively connected with the crank shaft.

The stator 14 includes a cylindrical stator base element 18 which includes radially inward extending bars that are not illustrated in detail and arranged in uniform intervals at an inside 20 of the stator base element, so that an intermediary space is formed between two respective adjacent bars. Into this intermediary space a pressure medium, typically hydraulic fluid is introduced in a controlled manner by a hydraulic valve that is not illustrated in more detail. The stator 14 is configured including a rotatable rotor 22 of the cam phaser 12.

Figure 2:
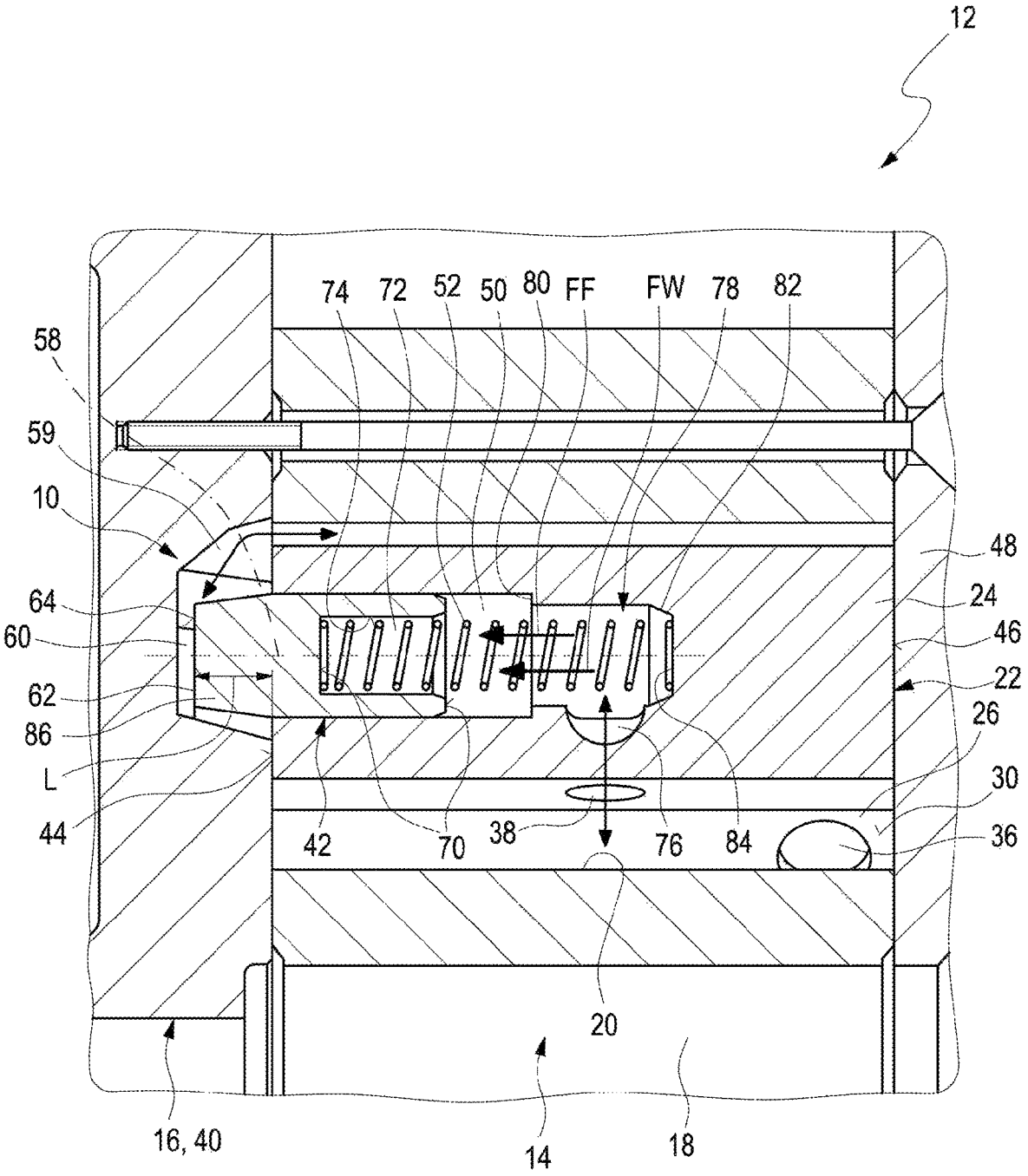
FIG. 2 illustrates a partial sectional view of a detail of a rotor of the cam phaser according to the invention.
Figure 3:
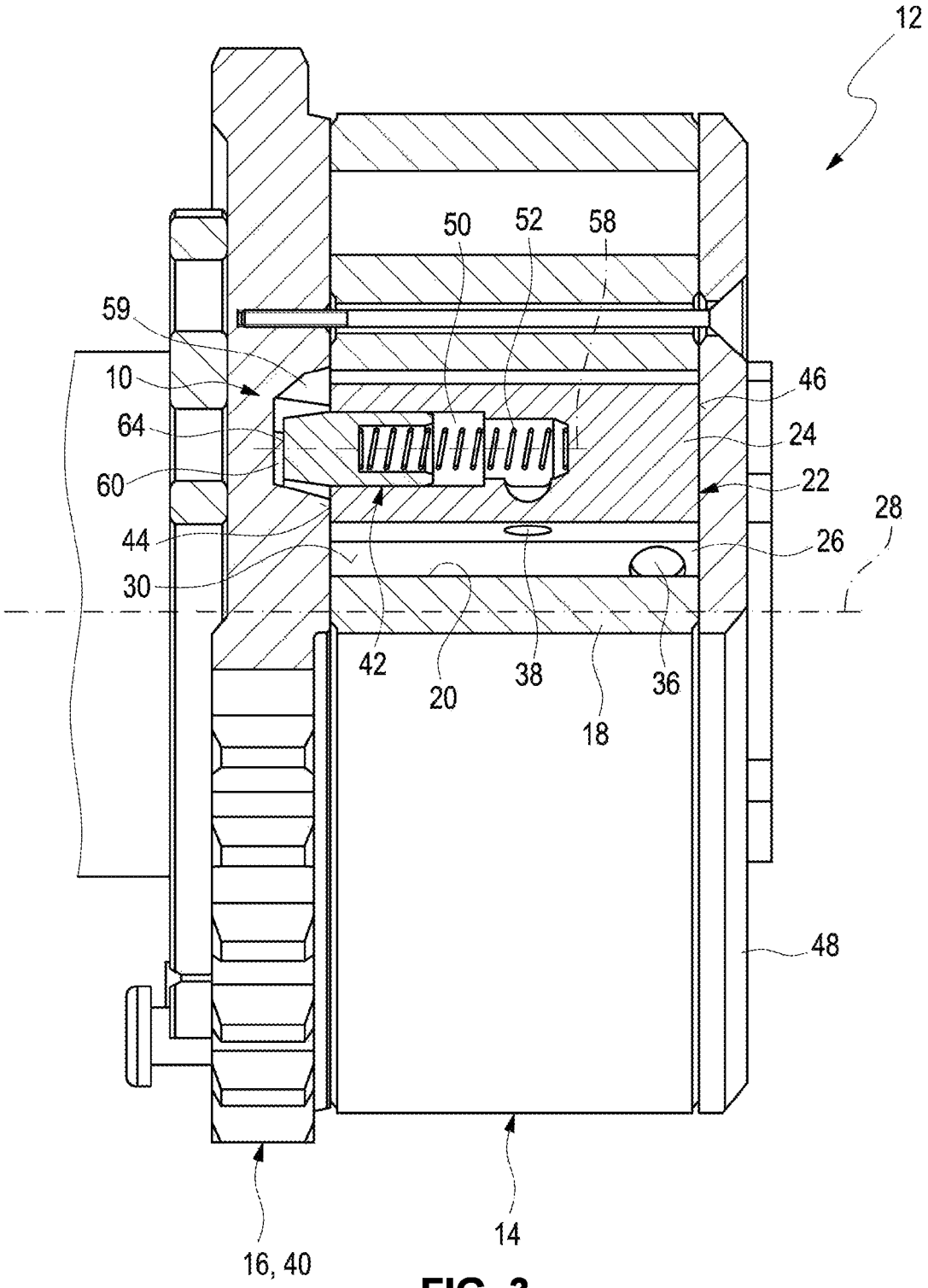
FIG. 3 illustrates a partial sectional view of the cam phaser according to FIG. 2.

A blade 24 is positioned so that it protrudes into the intermediary space wherein the blade is arranged at a rotor hub 26 of the rotor 22 as illustrated in FIGS. 2 and 3 of the cam phaser 12 according to the invention. Corresponding to a number of intermediary spaces the rotor hub 26 includes a number of blades 24. The rotor 22 includes a rotation axis 28 about which the rotor 22 is rotatably arranged.

Thus, the blades 24 divide the intermediary spaces respectively into a first pressure cavity and a second pressure cavity. The first pressure cavity is flow associated with a first operating connection of the hydraulic valve that is not illustrated in more detail and the second pressure cavity is flow associated with a second operating connection of the hydraulic valve that is not illustrated in more detail.

In order to reduce a pressure loss in the first pressure cavity and in the second pressure cavity the bars are configured so that they contact an outer enveloping surface 30 of the rotor hub 26 with their faces. By the same token the blades 24 contact the inside 20 in a sealing manner wherein the inside 20 is positioned opposite to the outer enveloping surface 30.

The rotor 22 is connected torque proof with the camshaft of the internal combustion engine. In order to adjust an angular position of the camshaft relative to the crankshaft the rotor 22 is rotated relative to the stator 14 about the rotation axis 28, wherein the stator 14 is arranged coaxial to the rotor 22. Thus, the pressure medium in the first pressure cavity or the pressure medium in the second pressure cavity is pressurized as a function of a selected direction of rotation while the second pressure cavity or the first pressure cavity is unloaded. The unloading is performed by a tank access configured as an unloading channel 34 which is opened for unloading.

In order for the rotor 22 to be rotated counter clockwise relative the stator 14 first radial hub bore holes 36 are pressurized by the hydraulic valve wherein the first radial hub bore holes are uniformly spaced along the circumference of the rotor hub 26 as illustrated in particular in FIG. 2. In order to rotate the rotor 22 clockwise relative to the stator 14 the radial second hub bore holes 38 are pressurized by the hydraulic valve wherein the second radial hub bore holes are also arranged distributed over the circumference of the rotor hub 26, wherein the radial second hub bore holes 38 are positioned radially and axially offset from the first hub bore holes 36.

In order to interlock the stator 14 with the rotor 22 the locking device 10 is provided. The locking device 10 in addition to a locking disc 40 that is arranged coaxial to the rotor 22 or the stator 14 which locking disc is configured in this embodiment in the form of a drive wheel 16, includes a locking bolt 42. The locking disc 40 is configured so that it contacts a first rotor disc surface 44 of the rotor 22 flat. A cover 48 for covering the rotor 22 and the stator 14 is positioned at a second rotor disc surface 46 of the rotor 22 which is oriented away from the first rotor disc surface 44.

The locking bolt 42 is received axially movable in a receiving opening 50 in one of the blades 24. The locking bolt 42 is configured cylindrical and includes at least part of a preload element 52 that is configured as a coil spring. In the position of the locking bolt 42 that is illustrated in FIG. 1, the locking device 10 is arranged in its locking position.

Thus, the coil spring 52 is supported at a support element 54 which substantially closes the receiving opening 50 at the second rotor disc surface 46, so that an axial movement of the locking bolt 42 in a direction towards the second rotor disc surface 46 is limited. The receiving opening 50 includes a longitudinal axis 58 along which the locking bolt 42 is axially movable.

A first load channel 59 leads to a load cavity 60 that is configured in the locking disc 40. This load cavity 60 is hydraulically loadable. When hydraulic fluid flows into the load cavity 60 the locking bolt 42 is loaded by the hydraulic fluid and pressed against the coil spring 52 in a direction towards the support element 54. As soon as an end 62 of the locking bolt 42 that is oriented away from the support element 54 is coplanar with the first rotor disc surface 44, unlocking is performed and the rotor 22 is rotatable relative to the locking disc 40 or in this embodiment relative to the drive wheel 16. The hydraulic fluid flowing into the load cavity 60 includes a pressure pA which corresponds to a pressure in the first pressure cavity.

In order to perform the locking the rotor 22 is rotated into its locking position so that the receiving opening 50 and the load cavity 60 are positioned opposite to each other so that the locking bolt 42 is arrangeable in the load cavity 60. This rotation is performed by the different pressures in the pressure cavities, wherein the pressure pA of the first pressure cavity is provided for unlocking the locking device 10 and thus used to rotate the rotor 22 from the locking position. This means also that the load channel 59 is fluid connected with the first pressure cavity.

The load cavity 60 is provided so that it does not completely penetrate the locking disc 40. This means that the load cavity 60 is configured so that it does not completely penetrate the locking disc 40 in its axial extension. The load cavity 60 is open towards the rotor 22 and configured closed in its axial extension in a direction of the rotation axis 28 and oriented away from the rotor 22. The load cavity 60 is introduced as a groove into the locking disc 40.

The locking bolt 42 includes a pressure reaction surface which is configured in a form of a bolt base 64 of the locking bolt 42. The bolt base 64 is oriented towards the load cavity 60. In order to establish pressure compensation during loading the support element 54 includes a compensation opening 66 so that pressure compensation can be provided in a space configured between the locking bolt 52 and the support element 54.

The compensation opening 66 is flow connected with the relief channel 34 that is configured in the rotor 22 and which is used for draining the hydraulic fluid that is disposed in the receiving opening 50. Drainage can not only be provided through the relief channel 34 but also through a gap channel 68 that is provided between the rotor 22 and the support element 54. The flow direction of the hydraulic fluid is indicated by flow arrows wherein not only a draining but also a suction of the hydraulic fluid can be provided as a function of a pressure configured in the receiving opening 50. The compensation channel 68 is flow connected with the relief channel 34.

The locking device 10 of the cam phaser 12 according to the invention is configured for quicker positioning of the locking bolt 42 and in particular for improved locking, wherein the positioning and in particular the improved locking is performed by a spring force FF of the preload element 52 and by an additional force FW that impacts the locking bolt 42 directly.

Figure 4:
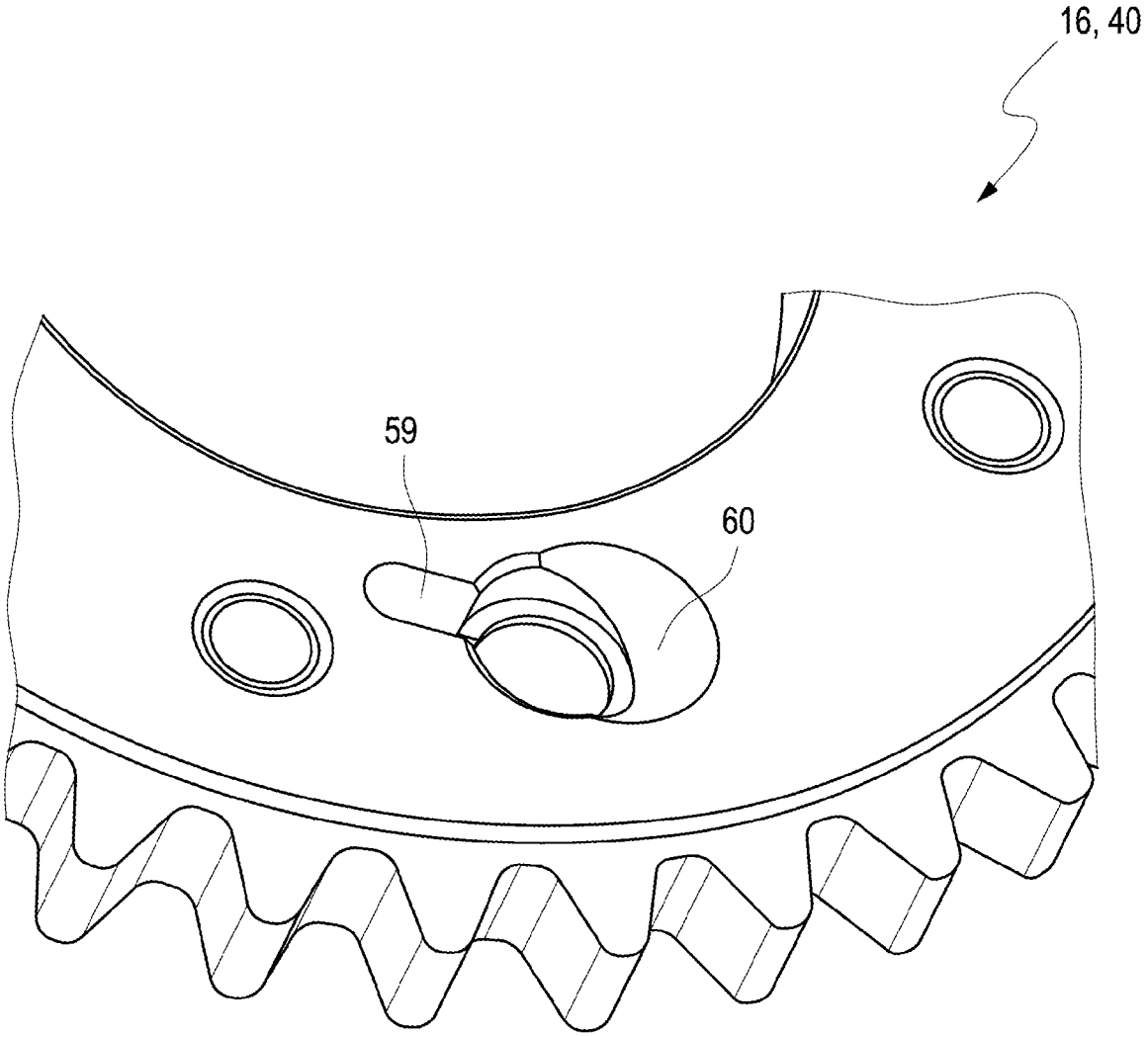
FIG. 4 illustrates a detail view of a locking disc of the cam phaser according to FIG. 2.

The cam phaser 12 according to the invention is illustrated in a partial sectional view of the rotor 22 and in a partial sectional view in FIG. 2 or FIG. 3. FIG. 4 illustrates a detail view of the blocking disc 40, in particular the load cavity 60 and the first load channel 59 that is flow connected with the load cavity 60.

While the locking device 10 of the cam phaser 12 that is known in the art only uses a pressure Pa that is provided in the first pressure cavity, the locking device 10 of the cam phaser 12 according to the invention additionally uses the pressure Pb provided in the second pressure cavity in order to provide quick locking. The pressure pB of the second pressure cavity is the pressure which causes the rotation of the rotor 22 into the locking position. The hydraulic flow which is provided according to the positioning of the rotor 22 is schematically illustrated by the flow arrows.

The additional force FW which acts upon the locking bolt 42 which supports the spring force FF results from the pressure pB of the second pressure cavity. The additional force FW impacts the locking bolt 42 directly at a bolt surface 70 that is oriented away from the bolt base 64.

The locking bolt 42 is configured partially hollow and includes a cavity 72 wherein the cavity 72 is provided for partially receiving the preload element 52. This cavity 72 in addition to providing a secure reception of the pre-load element 52 and a reduction of the weight of the locking bolt 42 has the essential advantage that a pressure reaction surface of the pressure pB is increasable. In this embodiment that is not illustrated in more detail the cavity 72 is configured so that it tapers towards the bolt base 64 so that pressure forces impact the conical cavity 72 at its cavity enveloping surface 74 wherein force components oriented along the longitudinal axis 58 cause an increase of the additional force FW.

The locking bolt 10 is thus configured for positioning the locking bolt 42 through the spring force FF of the preload 52 and through the additional force FW directly impacting the locking bolt 42. The additional force FW is configured as a hydraulic force of the hydraulic fluid flowing through the cam phaser 10.

In order to support the spring force FF and thus provide quicker locking the spring force FF and the hydraulic force FW are advantageously oriented in the same direction wherein a second load channel 76 is advantageously provided so that it opens at an end portion 78 of the receiving opening 50 wherein the end portion is oriented away from the first rotor disc surface 44 in order to provide balancing. This means put differently that the inlet of the second load channel 76 is arranged at an end portion 78 of the receiving opening 70 that is oriented away from the locking disc 40.

The second load channel 76 is flow connected with the second hub bore hole 38 which is associated with the second pressure chamber.

The receiving opening 50 includes a first shoulder 80 which is configured to limit the axial movement of the locking bolt 42. Additionally a second shoulder 82 that is cone shaped is provided at an end of the receiving opening 50 that is oriented towards the second rotor disc surface 46 wherein the receiving opening is configured to safely receive the preload element 52. In order to provide an advantageously large additional force FW the inlet of the second load channel is advantageously configured between the first shoulder 80 and the second shoulder 82 directly adjacent to the second shoulder 82. This means put differently that the inlet is configured at an end 84 of the receiving opening 50 that is oriented away from the locking disc 40 and/or between the first shoulder 80 of the receiving opening 50 that is provided for limiting the movement of the locking bolt 42 and the end 84.

The second load channel 76 is configured in this embodiment so that it radially penetrates the rotor 22 relative to the rotation axis 28 starting from the second hub bore hole 38. Thus, the load channel 76 is configured at its end that is oriented away from the receiving bore hole 50 so that the load channel is flow connected with the second pressure chamber.

The second load channel 76 can be configured from the second hub bore hole 38 so that the second load channel 76 is semi-axial or partially axial and semi-radial or partially radial to the rotation axis 28. In this context the terms semi-axial, partially axial, semi-radial and partially axial characterize a position of the load channel 76 at a slant angle relative to the rotation axis 28 and thus not orthogonal to the rotation axis 28.

Thus the locking bolt 42 of the cam phaser 12 according to the invention is loadable with the pressure pA of the first pressure cavity at an end of the cam phaser 12 that is oriented towards the locking disc 40 and which includes the bolt base 64, wherein the pressure pA corresponds to a first pressure of the first operating connection. At an end that is oriented away from the locking disc 40 and which includes the bolt surface 70, the locking bolt is loadable with the pressure pB of the second pressure chamber which pressure corresponds to a second pressure of the second operating connection. The locking device 10 is unlocked by the pressure pA and locked by the pressure pB. Thus, the pressures provided in the pressure chambers are used for simultaneously unlocking and locking the locking device 10, wherein a self-regulating locking device 10 is provided under the impact of the spring force FF.

In order to pressure load the locking bolt 42 at an end that is oriented towards the locking disc 40 the first load channel 59 that is flow connected with the receiving opening 50 is configured in the locking disc 40.

A bolt section 86 including the bolt base 64 of the locking bolt 42 is configured conical over a length L for improved and quicker locking.

REFERENCE NUMERALS AND DESIGNATIONS

10 locking device
12 cam phaser
14 stator
16 drive wheel
18 stator base element
20 inside
22 rotor
24 blade
26 rotor hub
28 rotation axis
30 outer enveloping surface
32 face side
34 relief channel
36 first hub bore hole
38 second hub bore hole
40 locking disc
42 locking bolt
44 first rotor disc surface
46 second rotor disc surface
48 cover
50 receiving opening
52 preload element
54 support element
58 longitudinal axis
59 first load channel
60 load cavity
62 end of locking bolt
64 bolt base
66 compensation opening
68 gap channel
70 bolt surface
72 cavity
74 cavity enveloping surface
76 second load channel
78 end portion
80 first shoulder
82 second shoulder
84 end of receiving bore hole
86 bolt section
FF spring force
FW additional force
L length

What is claimed is:

1. A cam phaser, comprising:

a rotor; and a stator, wherein the rotor is rotatable relative to the stator about a rotation axis of the rotor, wherein a blade of the rotor is arrangeable at various positions between two bars of the stator, wherein an intermediary space formed between the two bars is divided by the blade of the rotor into a first pressure cavity and a second pressure cavity, wherein a locking device including a locking bolt that is spring loaded by a preload element and a locking disc is configured to lock the stator with the rotor, wherein the preload element includes a spring force for locking, wherein the locking bolt is received axially movable in a receiving opening that is flowable by a hydraulic fluid and that is oriented in a direction of a longitudinal axis of the receiving opening that is formed in the rotor, wherein the rotor is movable by pressures provided in the first pressure cavity and in the second pressure cavity, wherein the rotor includes a locking position for locking, wherein a hydraulic valve is provided for pressure loading and pressure relief, wherein the locking device is configured to position the locking bolt by the spring force and by an additional force directly impacting the locking bolt, wherein the additional force is a hydraulic force of the hydraulic fluid flowing through the cam phaser and into the receiving opening, wherein the spring force and the hydraulic force are oriented in an identical direction, wherein the locking bolt is loadable by the hydraulic force in any axial position of the locking bolt in the receiving opening, and wherein the receiving opening is not connected with ambient pressure in any axial position of the locking bolt in the receiving opening.

2. The cam phaser according to claim 1, wherein the additional force includes the pressures that are provided in the pressure cavities for moving the rotor into the locking position.

3. The cam phaser according to claim 1, wherein a second load channel of the cam phaser opens into the receiving opening to introduce the additional force.

4. The cam phaser according to claim 3, wherein an inlet opening of the second load channel is configured at an end portion of the receiving opening, and wherein the end portion is oriented away from the locking disc.

5. The cam phaser according to claim 4, wherein the inlet opening is configured at an end of the receiving opening that is oriented away from the locking disc or between a shoulder of the receiving opening and the end of the receiving opening in order to limit the movement of the locking bolt.

6. The cam phaser according to claim 3, wherein the second load channel penetrates the rotor partially relative to the rotation axis radially or semi-axially.

7. The cam phaser according to claim 1, wherein the locking bolt is configured loadable by a hydraulic pressure of a first operating connection of the hydraulic valve at an end of the locking bolt that is oriented towards the locking disc, and the locking bolt is configured load able by a hydraulic pressure of a second operating connection of the hydraulic valve at an end of the locking bolt that is oriented away from the locking disc.

8. The cam phaser according to claim 3, wherein the second load channel flow connected with the second pressure cavity at an end of the second load channel that is oriented away from the receiving opening.

9. The cam phaser according to claim 1, wherein a first load channel of the cam phaser that is flow connected with the receiving opening is configured at least partially in the locking disc in order to provide pressure loading of the locking bolt during unlocking of the locking bolt.

10. The cam phaser according to claim 1, wherein the locking disc is configured as a drive wheel that is connected torque proof with the camshaft.

* * * * *